United States Patent [19]

Piccardo

[11] 4,023,593

[45] May 17, 1977

[54] VALVE AND CONTROL THEREFOR

[75] Inventor: Jack E. Piccardo, Oakland, Calif.

[73] Assignee: The Rucker Company, Oakland, Calif.

[22] Filed: Feb. 17, 1976

[21] Appl. No.: 658,295

[52] U.S. Cl. ..... 137/625.64; 251/30; 251/282

[51] Int. Cl.[2] ..... F15B 13/043

[58] Field of Search ..... 137/625.6, 625.64; 251/30, 31, 33, 282

[56] References Cited

UNITED STATES PATENTS

| | | | |
|---|---|---|---|
| 2,831,650 | 4/1958 | Richardson | 251/282 X |
| 2,930,404 | 3/1960 | Kowalski et al. | 137/625.65 |
| 3,534,770 | 10/1970 | Kowalski | 251/282 X |
| 3,554,234 | 1/1971 | Kurtz | 137/625.64 |
| 3,559,686 | 2/1971 | Hoffman | 137/625.64 |
| 3,804,120 | 4/1974 | Garnett | 137/625.64 |
| 3,821,967 | 7/1974 | Sturman | 251/30 X |

FOREIGN PATENTS OR APPLICATIONS

| | | | |
|---|---|---|---|
| 1,207,169 | 12/1965 | Germany | 251/282 |
| 2,518,541 | 11/1975 | Germany | 137/625.64 |
| 566,054 | 8/1957 | Italy | 251/282 |
| 1,006,942 | 10/1965 | United Kingdom | 137/625.6 |

*Primary Examiner*—Alan Cohan
*Assistant Examiner*—Gerald A. Michalsky
*Attorney, Agent, or Firm*—Lothrop & West

[57] ABSTRACT

A hydraulic valve has a non-heating, low-power electric control. A main valve is movable in a main valve body to interconnect and isolate pressure, tank or drain and cylinder passages. Pressure to operate the main valve is controlled by pilot poppet valves having passages joined to the pressure and tank passages. The poppet pilot valves are individually actuated by the solenoids. Alternatively, the main valve body may have pressure and drain poppet valves arranged in pairs with similar, non-heating solenoid actuators for the pressure valves and cross-connected pressure actuation for the drain valves.

5 Claims, 13 Drawing Figures

FIG-2
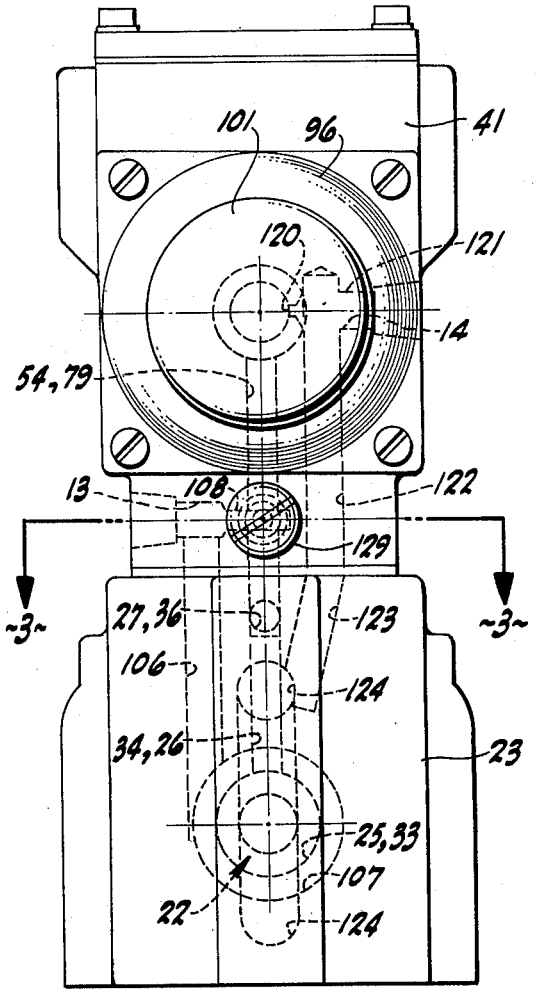
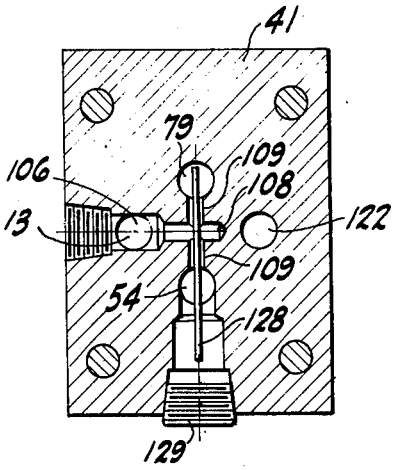
FIG-3
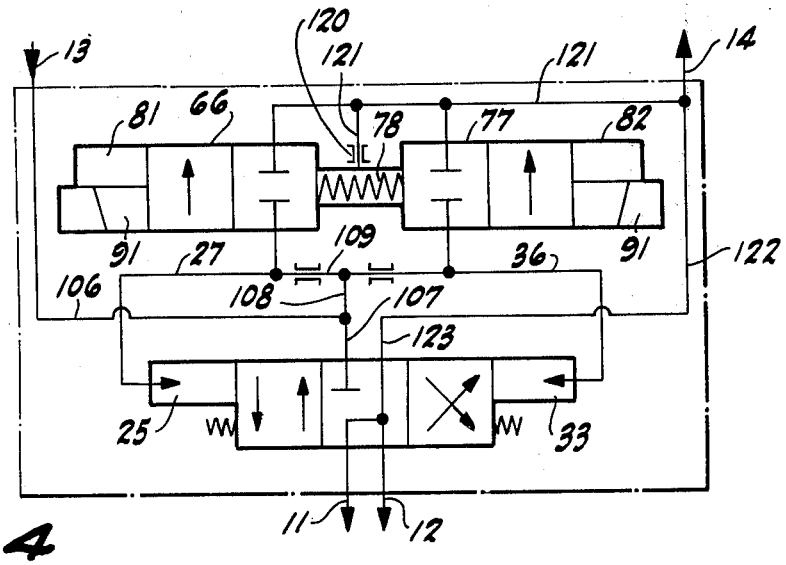
FIG-4

FIG-9
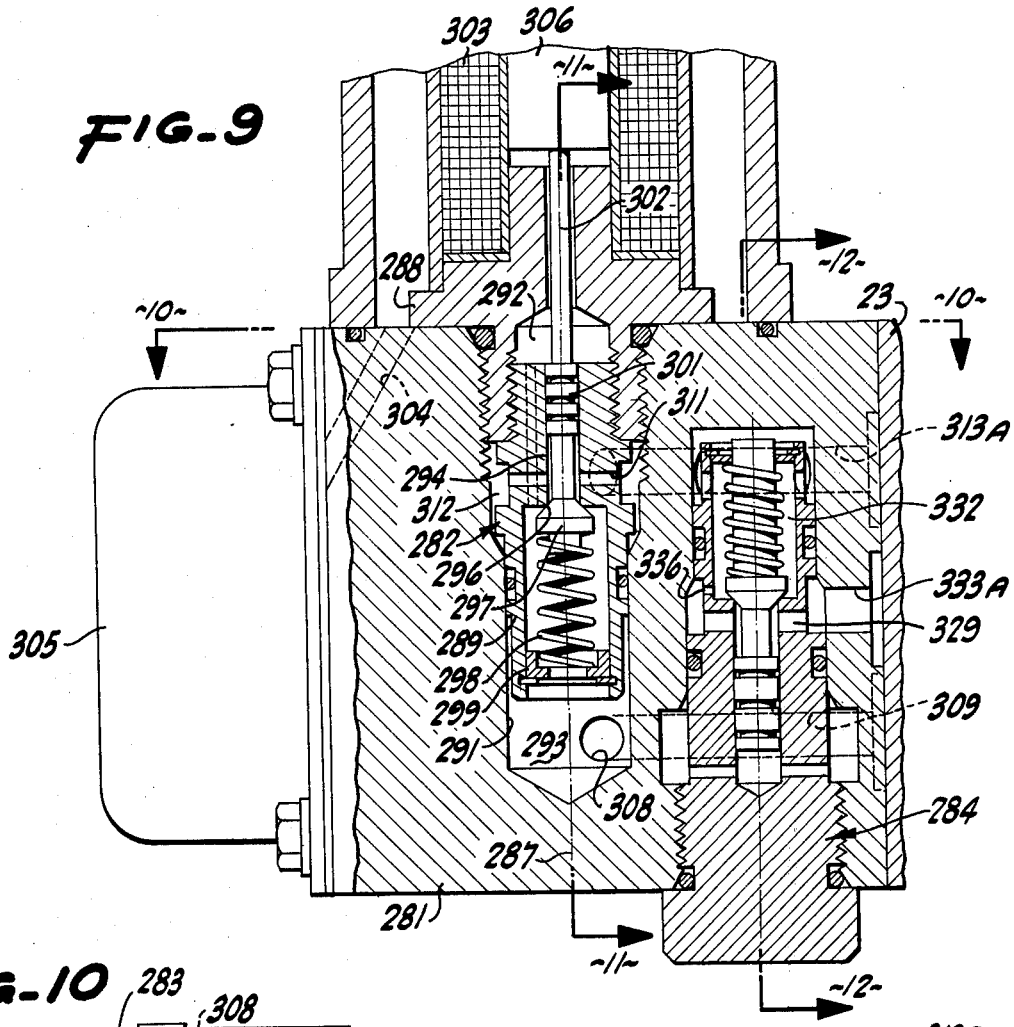
FIG-10
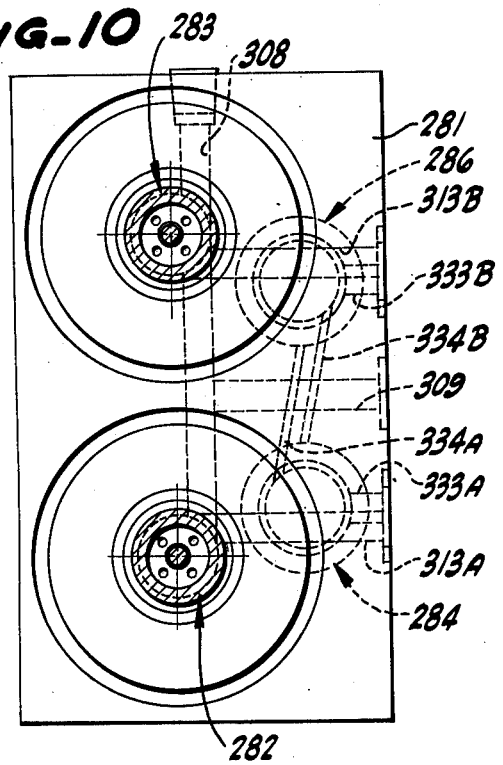
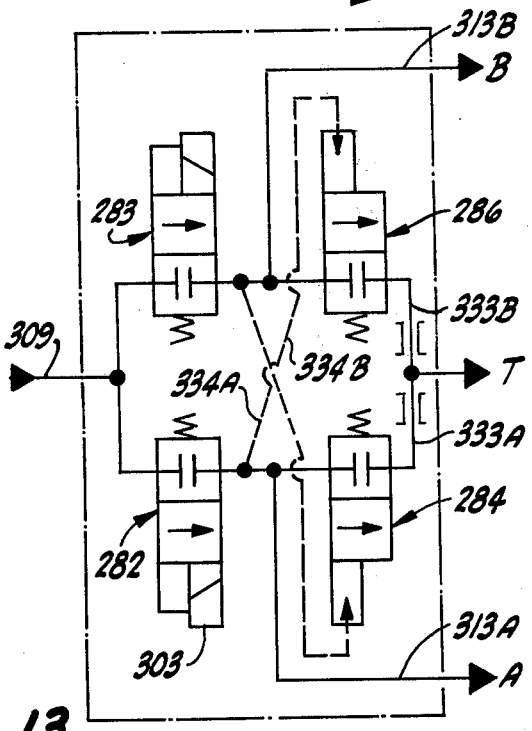
FIG-13

VALVE AND CONTROL THEREFOR

In the operation of hydraulic equipment, particularly large size hydraulic equipment, it is often desirable to provide the advantages of electrical control. This usually involves employing an electrical actuator such as a solenoid. A difficulty arises, however, in that in many environments the electricity necessarily utilized is of such wattage as to cause overheating, possible vaporization of the hydraulic fluid used and sometimes hazards such as explosions. In many instances, therefore, electrical control cannot be used with hydraulic equipment.

It is therefore an object of the invention to provide a valve and control therefor arranged to utilize electricity but at a relatively low power so that any resulting heating is inconsequential and is safe.

Another object of the invention is to provide a valve and control therefor in which the arrangement is especially characterized by an ability to handle temperatures and to maintain temperatures at a low and safe value.

Another object of the invention is to provide a valve and control therefor which is not only compactly arranged but is laid out in such a way as to take adequate care of heat transfer in order to avoid localized or general overheating or any untoward temperature rise.

Another object of the invention is to provide a valve and control therefor that generally can be actuated electrically but without hazard restrictions.

A further object of the invention is in general to provide an improved valve and control therefor.

Another object of the invention is to provide a solenoid valve environment in which the temperature rise of the solenoid coil during operation is adequately low to preclude any vaporization of the hydraulic fluid and adequately low to operate safely in a hazardous atmosphere; that is, to release insufficient energy under normal and abnormal conditions to cause ignition of hazardous gas mixtures such as may occur on a tanker transporting volatile liquids.

Other objects, together with the foregoing, are attained in the embodiments of the invention described in the accompanying description and illustrated in the accompanying drawings, in which:

FIG. 2 is an end elevation of the structure disclosed in FIG. 1;

FIG. 3 is a cross-section, the plane of which is indicated by the line 3—3 of FIG. 2;

FIG. 4 is a diagram showing with conventional symbols and schematically the hydraulic circuitry of the hydraulic valve and control of the invention;

FIG. 9 is a view, largely in cross-section in a vertical plane, of a modified form of hydraulic valve and control, the axes of major components being vertical;

FIG. 10 is a cross-section through the device of FIG. 9, the plane of section being indicated by the line 10—10 of FIG. 9;

FIG. 13 is a diagram showing with conventional symbols and diagrammatically the hydraulic circuitry of the device of FIG. 9.

Figure 1:
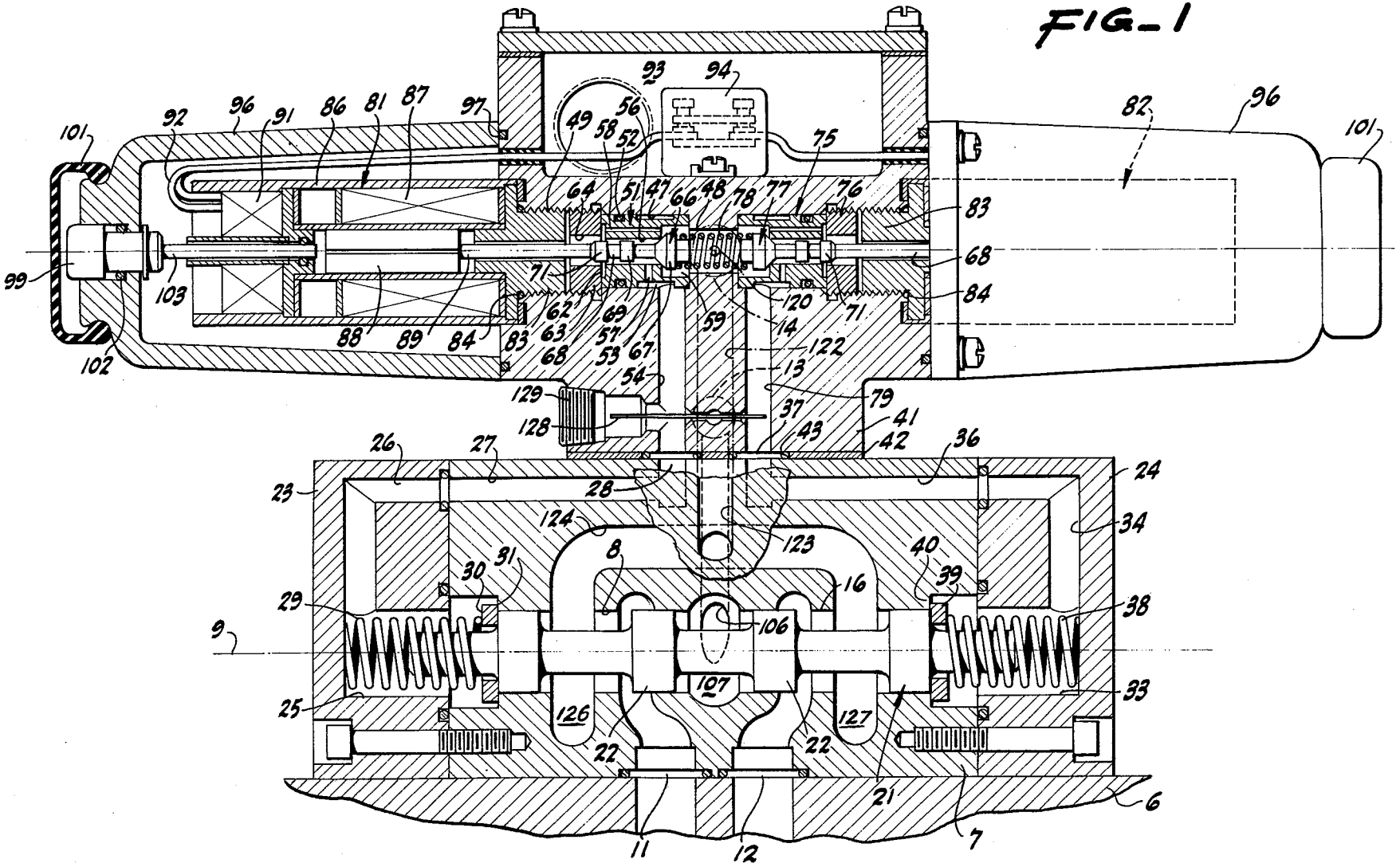
FIG. 1 is a side elevation with most portions broken away in cross-section on an axial, vertical plane through one form of hydraulic valve and control pursuant to the invention.

The mechanism of the invention can be utilized in a number of different environments, but for many istallations an arrangement as disclosed in FIG. 1 is appropriate. It is assumed that the mechanism to be hydraulically actuated is arranged in such a fashion as to have a pad 6 on which the valve structures can be mounted. The pad 6 is likewise intended to represent an operated device such as a cylinder or the like which has a port at each end, both to receive hydraulic fluid under a higher pressure and to discharge hydraulic fluid at a lower pressure. In such an installation there is afforeded a main valve body 7. This is usually a block of metal and is provided with a main circular cylindrical bore 8 therein symmetrical about a main axis 9. Likewise formed in the main valve body 7 are various passages such as cylinder passages 11 and 12 joined through appropriate connectors in the base 6 to the cylinder ports (not shown) and likewise having, as especially shown in FIGS. 2 and 3, a high pressure or supply passage 13 and a low pressure or tank passage 14. These passages are joined in the customary way to normal, related equipment. The pressure passage goes to a suitable source of hydraulic fluid under relatively high pressure such as a pump taking from a reservoir and may be connected to a pressure regulator, a screen or filter or the like, whereas the tank passage is effective to return low pressure, discharged hydraulic fluid back to the reservoir feeding the pump. All of that is standard so is not disclosed in detail.

The bore 8 in the body 7 forms a series of lands 16 of the usual sort dividing the various passages from each other and all generally of the same diameter or circular-cylindrical configuration so as to receive a balanced main valve spool 21. This is contoured with a number of circular-cylindrical lands, such as 22 thereon, all symmetrical about the axis 9. The valve spool is reciprocable endwise or axially so that by its position it can control hydraulic flow between the various passages to afford the customary four-way connections.

In the present instance the valve spool is especially actuated. For that reason, to the opposite ends of the main body 7 are attached chamber blocks 23 and 24. These are substantially identical so that the general description of one applies to the other. The chamber block 23 defines an interior chamber 25, referred to as a first chamber, that is open to one end of the main valve spool 21. The chamber 25 is connected by an internal passage 26 to a connecting passage 27 in the main valve block 7, in turn opening through a port 28 at the face of the block 7. Within the chamber 25 is a centering or restoring spring 29 bearing against the chamber body and against a washer 30 seated against the end of the valve spool and also against a shoulder 31 in the main valve body 7.

Comparably, the block 24 defines a second chamber 33 open to the other end of the valve spool and having a passage 34 merging with a passage 36 opening to the outside of the main valve body 7 through a port 37. A centering spring 38 in the chamber 33 bears against the chamber block and also against a washer 39 seated on an end land of the valve spool and against a shoulder 40 at the end of the main valve block 7. With this arrangement, when there is no difference in hydraulic pressure between the first chamber 24 and the second chamber 33, the springs 29 and 38 centralize the valve spool in the main valve body in the position shown in FIG. 1. However, when the pressure in one of the chambers is lowered from that in the other chamber, then the valve spool is hydraulically shifted toward the lower pressure chamber, compressing the contained spring, and shifting the spool lands 22 into a different relationship with the block lands 16, thus altering the hydraulic flow to from the cylinder ports 11 and 12.

Pursuant to the invention, special, low-power means are provided for varying the pressures in the first chamber 25 with respect to those in the second chamber 33. In this way the main valve spool which may be of large size and can control a large amount of high pressure hydraulic flow can nevertheless be readily operated and positioned with only a small force.

Mounted on and detachably secured to the main valve body 7 is a pilot valve body 41. Between the bodies there is provided an appropriate spacer 42 and sealing means 43 in the customary way just as such seals and gaskets are provided elsewhere in the hydraulic mechanism.

The pilot valve body 41 is generally symmetrical about a central vertical plane so that a description of one side thereof applies substantially to the other side as well. In the pilot valve body, as it is usually mounted, there is a pilot valve bore 47 generally parallel to the axis 9 but of several different diameters. Centrally, the pilot valve bore 47 has a reduced annular band 48 while toward the ends the bore 47 is enlarged and is provided with internal threads 49.

Disposed in the enlarged portion 47 is a first valve capsule 51 sometimes called a cartridge. This is a separate body having a relatively snug fit in the bore 47 and is adapted to seat against the end of the band 48. The capsule 51 has an annular O-ring seal 52 helping to isolate a peripheral groove 53 designed to communicate with a passage 54 extending from the port 28. The groove 53 is connected to a central bore 56 by a radial passage 57. There is likewise a through bore 58 in the capsule extending from an end chamber 59 therein to an end cup 62 at the other end thereof. The valve capsule is held in position against the band 48 by a screw ring 63 having a central opening 64 therein.

Adapted to operate within the first capsule is a first poppet valve 66 having a conical seat 67 designed to rest or close at the bottom of the end chamber 59. The poppet valve includes a stem 68 with a central collar 69 thereon and a stem head 71. With this arrangement, when the screw ring 63 is removed the capsule containing the poppet valve can be withdrawn from the bore and the valve and the capsule can be serviced and easily replaced.

Quite similarly, there is a second pilot valve capsule 75 to the right of the center plane and this capsule is similarly retained by a screw ring 76. There is in it a second poppet valve 77 virtually identical to the valve 66. Between the valves and acting to urge both of them toward seated position is a spring 78 disposed in the pilot bore 48.

The second pilot valve capsule 75 has interior passages just like the first valve and is joined in the general hydraulic circuitry by a passage 79 between the port 37 and the groove 53 around the second valve.

In order to actuate the poppet valves which require only a small amount of energy, there is provided on the pilot valve housing a pair of solenoids 81 and 82 of a similar nature. A description of one, therefore, applies as well to the other. The solenoid 81 has a threaded boss 83 screwed into the threaded portion 49 of the pilot bore and is seated against an O-ring 84. The solenoid not only has a jacket 86 surrounding a coil 87 but likewise houses a longitudinally grooved core 88 acting on a stem 89 generally in abutment with the end of the valve stem head 71. In addition, within the solenoid jacket 86, there is provided an electrical mechanism 91 such as a diode assembly joined to conductors 92 extending into a chamber 93 in the pilot valve housing and within which is provided a junction block 94 for connection of control circuitry, not shown, to the solenoid coils.

It is desirable to protect the solenoids but also to afford an opportunity for manual operation of the solenoid cores 88 as well as electrical operation thereof. There is consequently provided for each solenoid a removable jacket 96 resting against the end of the pilot valve housing and having a seal ring 97 to preclude leakage therebetween. At the exposed end of the housing 96 and in alignment with the solenoid core 88 is a thumb button 99 under a removable, flexible cap 101 and also sealed by an O-ring 102. The button 99 is effective to displace a central rod 103 against the core 88. When the solenoid is activated by energization of the coil 81 or when the thumb button 99 is moved to the right in FIG. 1, the solenoid core is displaced to the right and moves the stem 89 to open the poppet valve 66 against the urgency of the closing spring 78. When the thumb button is not depressed and when the solenoid core is deenergized then the poppet valve 66 is closed or seated under the urgency of the spring 78, as illustrated in FIG. 1

A quite similar environment is provided for the poppet valve 77, which is opened when the solenoid 82 is energized or when its corresponding thumb button is depressed but not otherwise.

In the operation of this structure, hydraulic fluid under pressure is available at the pressure port 13 which flows through a passage 106 (FIGS. 2 and 4) into the central groove 107 in the main valve body. In addition, pressure fluid from the port 13 is led into a cross passage 108 (FIGS. 2 and 3) which opens into a shunt passage 109 joining the passage 54 and the passage 79. In this way pressure fluid is not only provided to the main valve body in the groove 107 but is likewise provided through the passage 108 and the shunt passage 109 and the passages 54 and 79 to the end chambers 25 and 33 and also to all of the connecting passages in the first and second pilot valves and in the solenoids. In this way there is a substantial balance provided at the opposite ends of the valving structure.

In a somewhat comparable fashion the tank port 14 (FIGS. 1, 2 and 4) is joined not only by a cross passage 121, having a choke bore 120 therein, to the central portion of the pilot valve bore in the vicinity of the spring 78, but likewise is joined to a vertical passage 122 having an inclined lower end 123 opening into an inverted U-shaped tank passage 124 leading to grooves 126 and 127, as shown in FIG. 1. In this way the tank pressure, which is relatively low, is also made available in a balanced fashion between the two pilot valve poppets and also in the two grooves 126 and 127. Liquid in the vicinity of the stems 89 and cores 88 can ebb and flow with movement of those parts, since there is always communication with the tank passage 14 through the bores 58 and the pilot valve bore 47.

With this arrangement, when the mechanism is positioned as shown in FIG. 1, there is always hydraulic fluid under pressure supplied to the parts generally in a balanced fashion and with some cross flow between the passages 54 and 79 and a corresponding flow toward the tank. It is usually important to keep the amount of this cross flow and out flow at a relatively small value. But since it is also desired not to have small orifices, the shunt passage 109, as particularly shown in FIGS. 1 and 3, is provided with a metering rod 128. This rod is accessible for replacement, cleaning or different sizing to control rate of valve spool motion by the removal of a plug 129 in the lower portion of the pilot valve body 41.

As shown in FIG. 1, the parts are in a neutral position, both of the cylinder passages 11 and 12 are open to drain 14 and neither is subject to hydraulic flow. Both solenoids are deenergized and both poppets are closed by spring pressure. The central guides 69 make close fits in the capsules so that leakage is small, the poppets when closed being generally under balanced pressures internally and externally. If it is desired to provide such flow, however, the user energizes the appropriate one of the solenoids 81 and 82. For example, assuming that the first solenoid coil 87 is energized, then the first poppet valve 66 is lifted from its seat against the spring 78. This has the effect through the passages 26 and 27, the port 28, the passage 54, the groove 53 and the radial passage 57 of connecting the first chamber 25 to the tank or low-pressure port 14. That being true and other pressures remaining as before, the pressure within the chamber 25 immediately drops and the main valve spool 21 shifts to the left, in FIG. 1, against the urgency of the spring 29. This moves the appropriate lands 22 so that the pressure groove 107 is joined to the cylinder passage 11, thus pressurizing the particular, connected cylinder or cylinder end. At the same time, since the valve spool 21 has shifted, the cylinder passage 12 is still joined but through an enlarged flow passage to the groove 127 and through the tank passage 124 to the tank passage 14.

In a similar fashion after the solenoid coil 87 has been deenergized the poppet valve 66 is closed, and when the other solenoid 82 is energized the other poppet valve 77 is opened. The resulting drop in pressure in the chamber 33 shifts the spool 21 to the right in FIG. 1. This connects the pressure groove 107 to the cylinder passage 12 and leaves the cylinder passage 11 connected to the tank passages 124 and 14. The actual movement of the valve spool is done hydraulically by pressure differential between the chambers 25 and 33 which may be quite large even though the force needed to move either of the poppet valves 66 and 77 is relatively small. The amount of electric power required by either of the solenoids 81 and 82 is small, about 0.75 watt, and the resulting heating of the solenoid coils is quite small. Furthermore, there is adequate thermal conducting and radiating material arrayed around the solenoids to serve as a heat sink or a heat dissipating member. Consequently, it is possible with this arrangement not only to control the flow of large amounts of high pressure fluid by means of the main valve but to utilize a very small amount of electrical power, thus keeping the temperature down and well below a value at which there might be danger. The present valve, therefore, is inherently quite safe, although electrically controlled.

Figure 5:
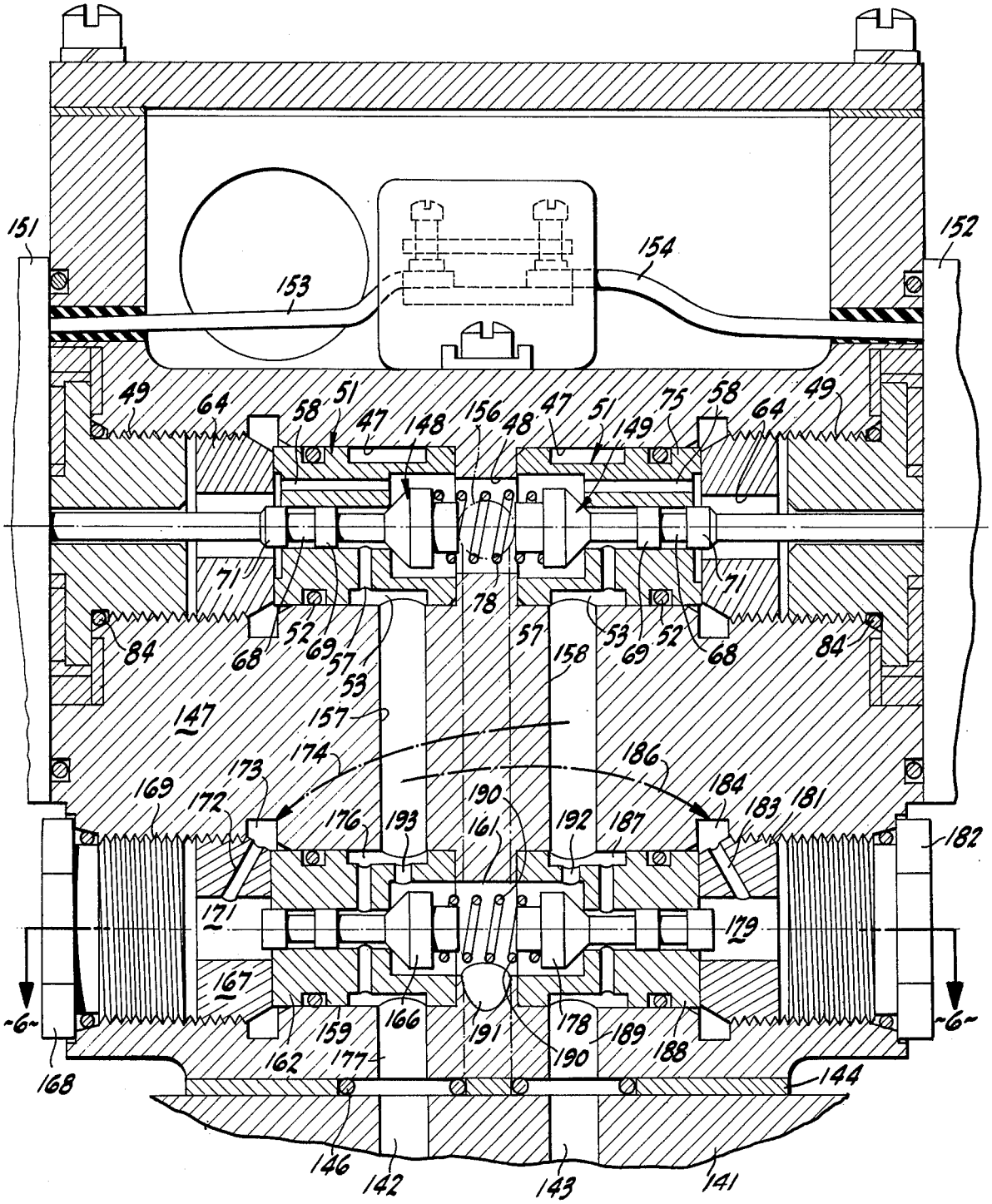
FIG. 5 is a view, to a greatly enlarged scale, of an entirely poppet valve version of the four-way valve and control generally similar to the FIG. 1 version.
Figure 6:
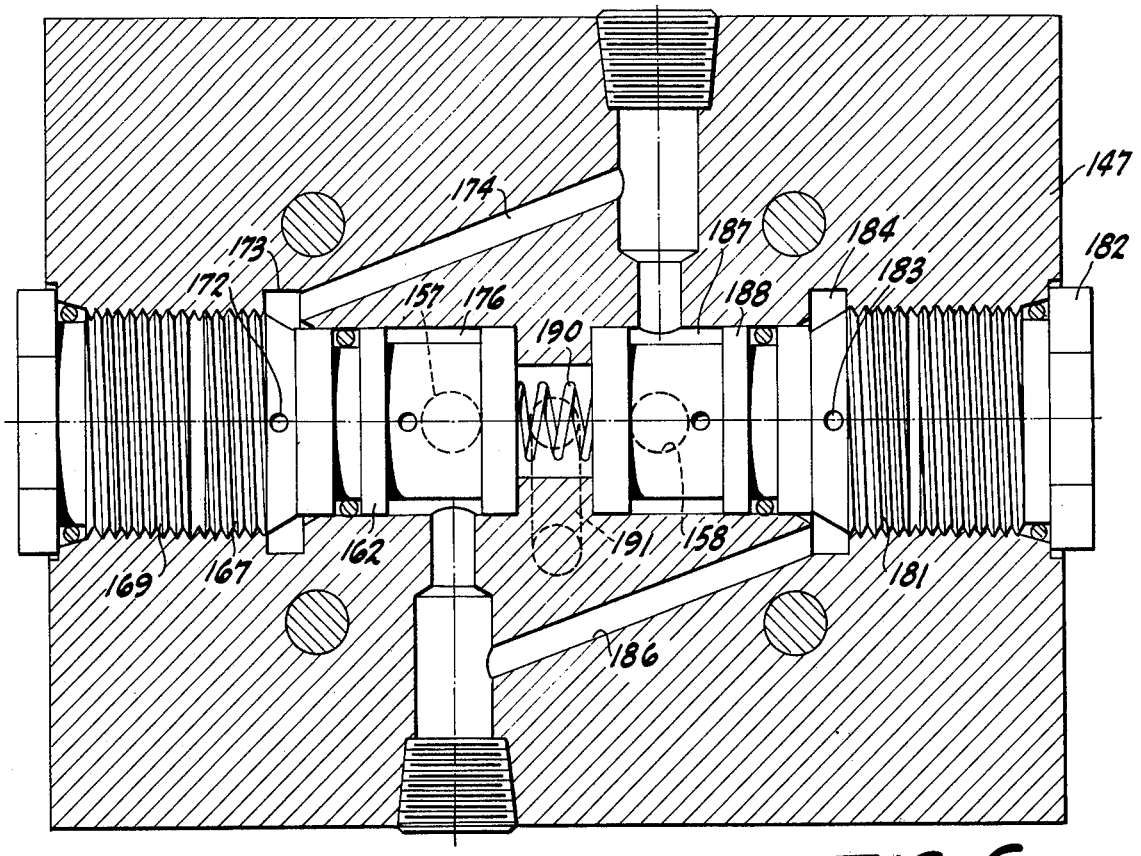
FIG. 6 is a cross-section, the plane of which is indicated by the line 6—6 of FIG. 5.
Figure 7:
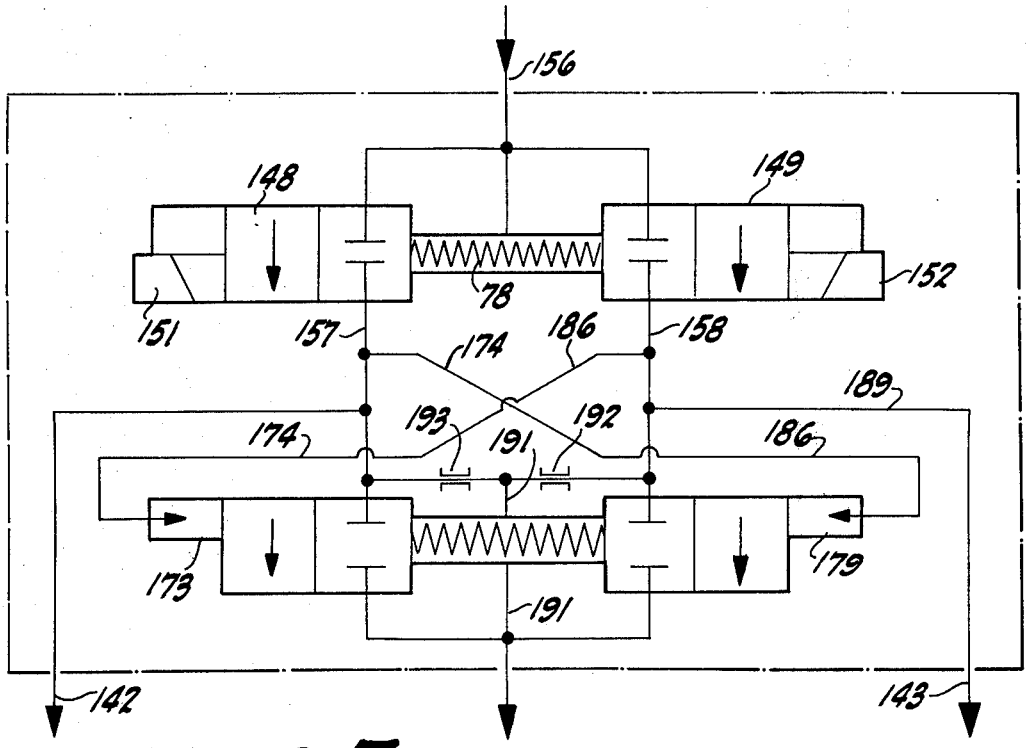
FIG. 7 is a hydraulic diagram utilizing standard symbols and illustrating schematically the hydraulic interconnections of the device of FIG. 5.

It is not always necessary to utilize a spool type valve as the main valve, and in some instances it is preferred to utilize poppet valves throughout. As shown particularly in FIGS. 5, 6 and 7, there is an arrangement in which the auxiliary or pilot valves are about as previously described and the main valves are also poppet valves. The main valves are shown in relatively small size, desirable from the standpoint of interchangeability, but they can be much larger in the event greater quantities of flow are to be accommodated.

In this embodiment the valve structure is mounted on a base 141 having a cylinder passage 142 and another cylinder passage 143 therein. These passages go to the opposite ends, for example, of a cylinder and piston arrangement (not shown) and correspond generally to the passages 11 and 12, previously described. Mounted on the base 141 through an intermediate spacer 144 and appropriate sealing rings 146 is a valve body 147. In this instance since all of the valves are relatively small the body is integral, although it can be divided, if desired. In the upper portion of the body 147, there is provided a pair of pilot poppet valves 148 and 149, respectively. These are identical in their construction and environment to those in the previous description. They are actuated by solenoids in housings 151 and 152 as previously described. Both solenoids are under the control of circuits connected to conductors 153 and 154 for individual control. There is a change, however, in that a port 156, corresponding in location to the previous tank or drain port 14, is now connected to pressure, as shown particularly in FIGS. 6 and 7. The pressure fluid from the customary source and available at the port 156 is stopped when the valves 148 and 149 are both closed. When the valve 148 is opened by actuation of the solenoid in the housing 151 against the urgency of the intervening spring 78, pressure fluid can flow into a passage 157. In a comparable fashion, when the solenoid in the housing 152 is energized and the pilot valve 149 is opened then pressure fluid is admitted to a passage 158.

The passages 157 and 158 are both in the valve body 147 and both communicate with a main bore 159 therein and having a reduced band 161 centrally thereof. Into end of the bore is inserted a main valve capsule 162 identical with the pilot valve capsules, such as 51 and 75, except that the through bores 58 are not provided. The capsule 162, for example, carries a similar, main poppet valve 166 held in position by a plug 167 backed up by a closure plug 168, both plugs fitting into an enlarged threaded bore 169 continuing the main bore 159. The plug 167 has an interior chamber 171 into which a stem of the poppet valve 166 can extend, the chamber being connected by a passage 172 to an annular pocket 173. In turn, the pocket 173 is joined by a bore 174 to the passage 158. The passage 157 communicates with a groove 176 in the capsule 162 which is in communication through a duct 177 with the passage 142.

In a similar fashion the other main poppet valve 178 has its stem extending into a compartment 179 in a plug 181 screwed into the body 147 and backed up by a closure plug 182. The plug 181 has a bore 183 therein opening into a pocket 184 joined by a passage 186 to the passage 157. The passage 158 is in communication with a groove 187 in the capsule 188 for the valve 178 and is thereby placed in communication with a passage 189 opening into the passage 143. both of the capsules 162 and 188 abut the reduced band 161. The poppets 166 and 178 are forced apart by a spring 190 like the spring 78. The main bore 159 in the vicinity of the spring 190 has a duct 191 which leads to the low pressure or tank portion of the circuit.

With this arrangement and with the parts in the position shown, the passages 142 and 143 are respectively connected to the grooves 176 and 187 which in turn are free to exhaust very slowly through bleed ports 192 and 193 in the cartridges and so leading to the tank duck 191. In this way the normal resting pressure within the passages 142 and 143 is only the tank pressure.

When the solenoid in the housing 151, for example, is energized, then the pilot poppet 148 is lifted off of its seat against the urgency of the spring 78 and pressure fluid from the port 156 flows around the open poppet 148 and into the passageway 157 and thus into the groove 176. Flow is then through the passageway 177 into the passage 142, so pressurizing such passage. While there is some slight leakage through the bleed port 193 to the tank duct 191, there is a more important flow from the pressure passage 157 through the passage 186 into the pocket 184 and thus through the bore 183 to the compartment 179. The increased pressure therein acting against the end of the poppet 178 opens such valve against the pressure of the spring 190 and connects the cylinder passage 143 through the groove 187 and the open valve to the tank duct 191. Thus, as the pressure in the passage 142 is increased, the pressure in the passageway 143 is neccessarily maintained at its lowest value.

When the solenoid in the housing 151 is no longer energized the spring 78 closes the poppet 148. Because of the bleed port 193 the pressure within the passages 157 and 186 and the chamber 179 is also then reduced. The spring 190 then closes the poppet 178. Both bleeds 192 and 193 are then effective to drop the pressure in both passages 142 and 143 to a low value.

When the solenoid in the housing 152 is energized then the valve 149 is electrically opened against the urgency of the spring 78 and pressure fluid from the port 156 flows into the passage 158 and into the groove 187 and the cylinder passage 143, tending to increase the pressure therein. Some of the pressure fluid in the passageway 158 leaks through the bleed port 192 to the tank duct 191, but this is a small amount. Pressure fluid within the passage 158 also is transferred through the passage 172 into the chamber 171. The pressure therein is correspondingly increased. Acting against the end of the stem of the poppet 166, the increased pressure opens that poppet against the urngecy of the spring 190 and thus connects the cylinder passage 142 through the duct 177 and the groove 176 to the drain or tank duct 191. There is thus pressure provided in the cylinder passage 143 and only a minimum pressure in the cylinder passage 142, thus obtaining the reverse result for the cylinder or cylinders. Again, when the solenoid in the housing 152 is deenergized the poppet 149 is closed by the spring 78, and the remaining pressure in the passage 158 and the bore 174 and the chamber 171 is bled off through the orifice 192 to the tank duct 191 so that the system is restored to its original low pressure equilibrium in both the cylinder passages 142 and 143.

Figure 8:
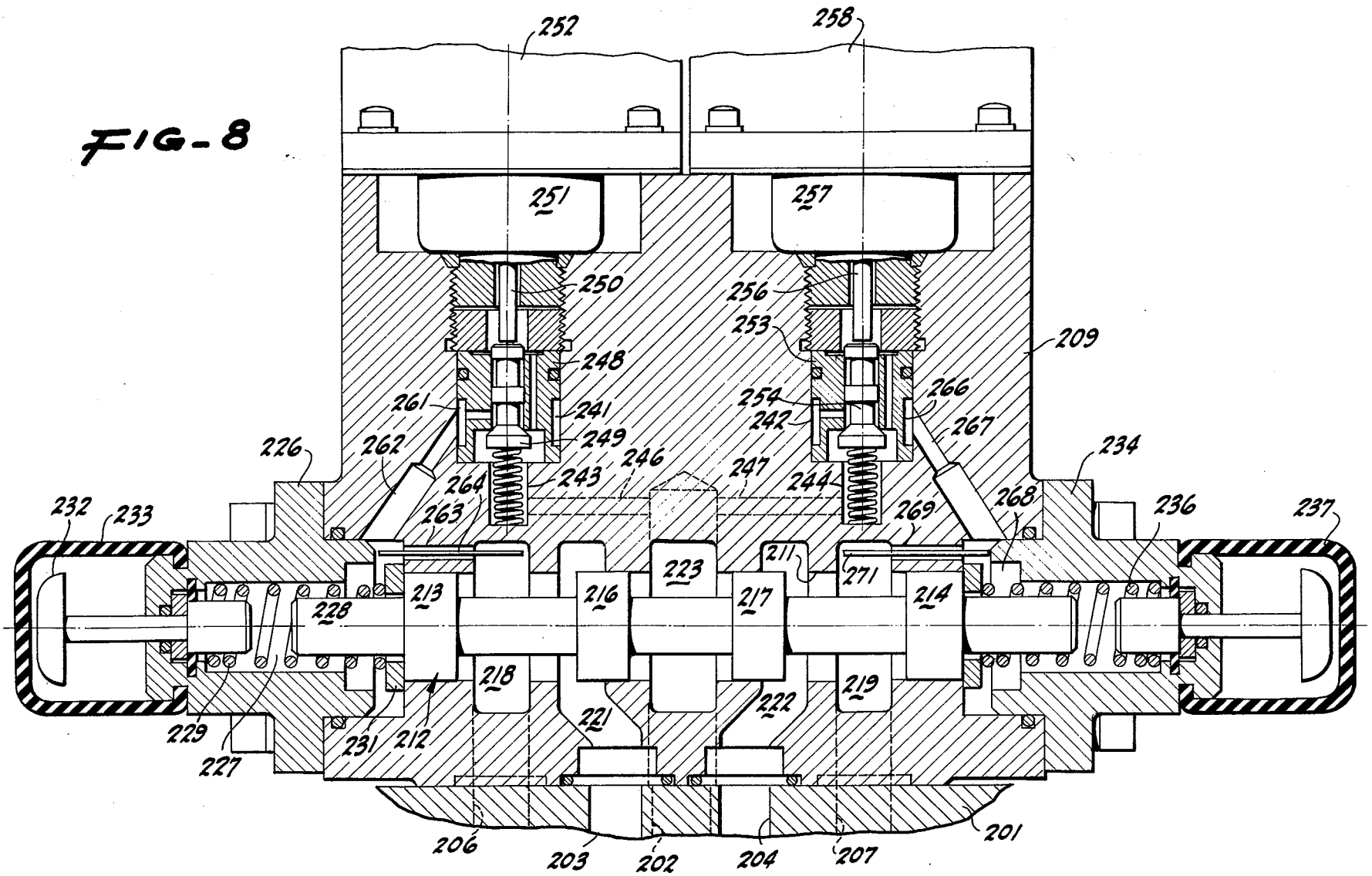
FIG. 8 is a sectional view comparable to FIG. 1 but showing a different arrangement of the hydraulic valve and control.

A variation on the foregoing embodiments is disclosed in the arrangement illustrated in FIG. 8. In this FIG. many of the parts are substantially identical with those previously described; and their operation, unless otherwise noted, is substantially the same, but certain variations are emphasized. In this instance the mechanism is mounted on a base 201 which there is provided a pressure or supply port 202, a cylinder port 203, another port 204 and two tank ports 206 and 207 respectively. Secured to the base 201 is a single block 209 having a main cross bore 211 with the customary lands, as previously described. Reciprocable with the bore is a main valve spool 212, itself having end lands 213 and 214 respectively and having intermediate lands 216 and 217 so that a pair of tank passages 218 and 219 can be connected to or isolated from a cylinder passage 221 connected to the port 203 and connected to or isolated from a passage 222 connected to the cylinder port 204. The pressure passage 202 is joined to a central, pressure chamber 223 which can correspondingly be connected to the passages 221 and 222.

At one end, the block 209 carries a cap 226 defining a chamber 227 into which projects one end 228 of the main spool. There is a spring 229 in the chamber 227 surrounding the projecting end 228 to rest against a centering washer 231. The other end of the spring 229 rests against the inner end of the cap 226. There is provided a hand-actuated plunger 232 in a flexible enclosure 233. The plunger is movable through appropriate seals by hand pressure against the end 228 of the main spool. By further movement of the plunger 232, the spool 212 can be translated toward the right in FIG. 8.

In a quite similar fashion the other side of the block 209 also has a closure cap 234 3nclosing a comparable spring 236 and having a similar hand-operated plunger 237. By operation of the plunger 237 the spool 212 can be translated toward the left in FIG. 8. The valve spool can thus be manually moved to connect the individual cylinder ports 203 and 204 to the pressure chamber 223 and to the tank passages 218 and 219. When released, the valve spool is centered in the position shown in FIG. 8 by the springs 229 and 236, both cylinder ports 203 and 204 being connected to the low pressure tank ports 206 and 207.

Pursuant to the invention and largely because of the large size of the main valve, there is provided an auxiliary or pilot valve mechanism so that only a small amount of power is needed to actuate a main valve of whatever size. For that reason the block 209 is extended to provide a pair of vertical bores 241 and 242 parallel to each other and each connecting at one end to respective spring chambers 243 and 244 in turn joined by passages 246 and 247 to the pressure chamber 223.

Both of the bores 241 and 242 are similarly equipped. The bore 241 carries a capsule 248 or cartridge exactly as previously described containing a poppet valve 249 adapted to be actuated by the stem 250 of a solenoid 251 mounted on the block 209. The solenoid has a protective cover 252 and appropriate electrical connections, as previously described. Quite similarly, the bore 242 carries a capsule 253 in which is disposed an appropriate poppet valve 254 arranged for actuation by the stem 256 of a solenoid 257 mounted on the block 209 within a cover 258. The various capsule or cartridge passages are as previously described, particularly in connection with FIG. 1.

In this instance, however, the connections are somewhat different. For example, the vertical bore 241 in the vicinity of a groove 261 around the capsule 248 connects with a passage 262 extending into the chamber 227 in the cap 226. That chamber in turn is connected through a passage 263 with the tank passage 218. Since flow through the passage 263 is intended to be restricted in a predetermined amount, there is provided a restricting rod 264 therein. Similarly, in the vicinity of a groove 266 in the capsule 253 the vertical bore 242 opens into a passage 267 leading into the interior chamber 268 of the cap 234. A passage 269 connects the chamber 268 with the tank passage 219. There is a throttling or restricting rod 271 in the passage 269.

In the operation of this structure the end chambers 227 and 268, respectively, are normally in communication through the restricted passageways 263 and 269 with the tank passages 218 or 219 leading to the low pressure tank lines 206 and 207. The main valve 212, when the poppet valves 249 and 254 are closed, as shown, is held centered by the springs 229 and 236 and is under only relatively low balanced pressure. High pressure from the chamber 223 and the port 202 is available through the passages 246 and 247 on the ends of both of the poppets 249 and 254. That pressure tends to keep both poppets closed as do the individual springs in the chambers 243 and 244.

When the solenoid 251 is energized, its stem 250 opens the poppet 249 against the urgency of the spring and permits pressure fluid to flow from the passage 246 into the groove 261, thence through the passageway 262 into the chamber 227. While there is some leakage of pressure fluid through the restricted orifice 263 to the tank chamber 218, the leakage amount is very minor. Pressure builds up within the chamber 227 sufficiently to displace the spool valve 212 to the right in FIG. 8 and thus to connect the pressure port 202 to the cylinder port 204 and to connect the cylinder port 203 to the drain or tank port 206. The spool valve 212 is free thus to move since the pressure within the chamber 268 is only tank pressure and despite movement of the valve spool is maintained at that pressure due to leakage through the restricted orifice 269 directly to the tank port 207.

When the solenoid 251 is deenergized and the poppet valve 249 is then re-closed by the spring in the chamber 243, the pressure within the chamber 227 promptly falls due to leakage through the drain orifice 263 to the tank port 206 so that the springs 229 and 236 again resume their function of centering the valve spool 212.

When the solenoid 257 is energized, its stem 256 opens the poppet valve 254 against the spring in the chamber 244 and permits pressure fluid from the chamber 223 to flow through the passage 247 into the groove 266 and through the passage 267 into the chamber 268. While there is some release of pressure fluid through the bleed orifice 269 to drain, that is a small amount, and the pressure within the chamber 268 builds up sufficiently to displace the valve spool 212 to the left in FIG. 8 against the urgency of the spring 229. The various valve lands are shifted to produce pressure in the cylinder port 203 and tank pressure in the cylinder port 204. Again, when the solenoid 257 is deenergized the parts are returned, as before, to the closed and central positions illustrated in FIG. 8.

In some installations a similar embodiment is desired, but it is preferred to make the arrangement so that the valves and the solenoids all operate on substantially upright or vertical axies.

Figure 11:
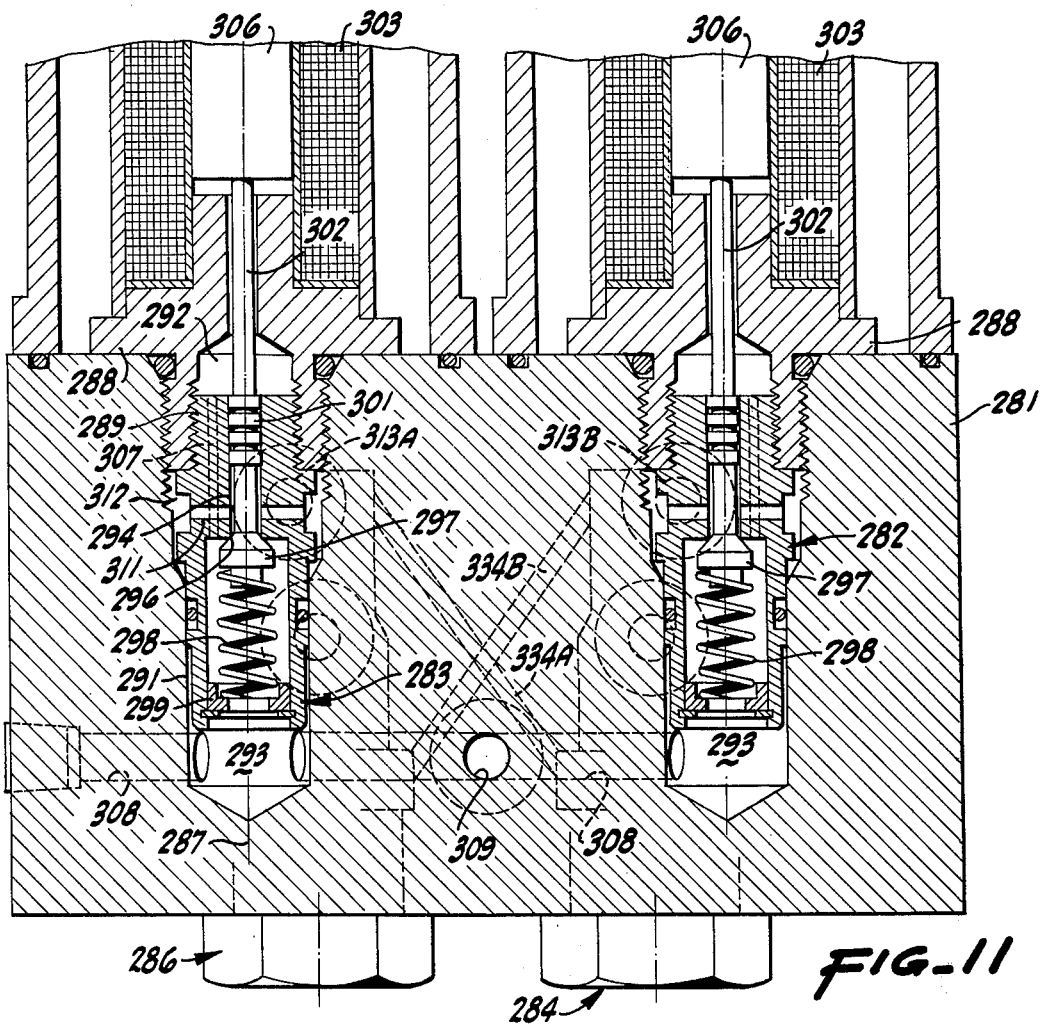
FIG. 11 is a cross-section through the device of FIG. 9, the plane of section being indicated by the line 11—11 of FIG. 9.
Figure 12:
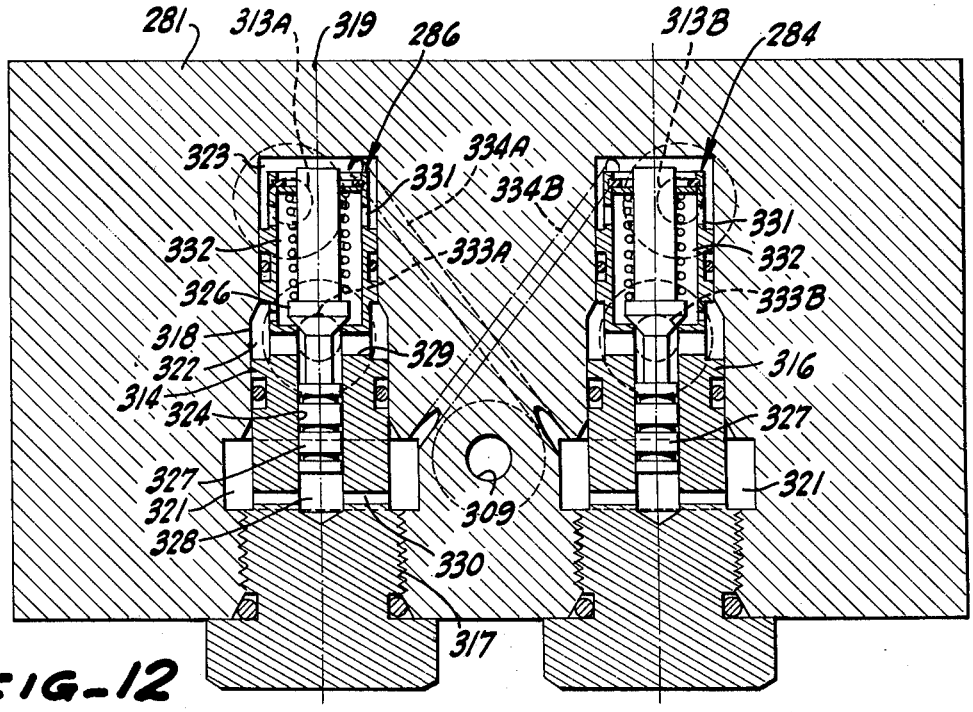
FIG. 12 is a cross-section through the device of FIG. 9, the plane of section being indicated by the line 12'—12 of FIG. 9.

The mechanism, as shown in FIG. 9, then includes the regular block 23, as previously described, to which there is appropriately secured a valve block 281 preferably incorporating duplex mechanisms and including for each mechanism a pressure valve and a drain valve. The two pressure valves, particularly as shown in FIG. 11, are designated 282 and 283 and the drain valves, as particularly shown in FIG. 12, are designated 284 and 286 respectively. The valves 282 and 284 are paired in some respects and the valves 283 and 286 are paired in those respects. Since the two pressure valves 282 and 283 are mutually indentical and the two drain valves 284 and 286 are mutually identical, the description of one pressure valve applies to both and the description of one drain valve applies equally to the other.

For example, the pressure valve 282 (FIGS. 9 and 11) is seated in the block 281 and is disposed along a vertical axis 287. Threaded into the block 281 is a support and guide plug 288 appropriately sealed by an O-ring. Into the plug 288 is threaded a cartridge 289, sometimes called a capsule a large portion of the cartridge being situated within a block bore 291 symmetrical with the axis 287. The cartridge seats in the support and guide plug 288 at the top to leave an upper chamber 292. The cartridge stops short of the bottom of the bore 291 to leave a lower chamber 293. The cartridge has a bore 294 therethrough of different diameters to define a valve seat 296 against which a poppet valve 297 rests in one position. The valve is urged toward its seated position by a spring 298 supported in position by a washer and snap ring combination 299. The valve 297 has a guide portion 301 of about the diameter of the seat 296 and disposed on an elongated stem 302, the stem extending through and above the support and guide plug 288.

Also seated on the plug 288 is a solenoid coil 303 appropriately connected by wires extending through a passage 304 (FIG. 9) in the block 281 and secured to conductors housed within a cover 305. Within the coil 303 is a movable armature 306 effective when the coil is energized to approach the support and guide 288, thus depressing the valve stem 302 and, against the urgency of the spring 298, opening the valve 297. When the coil 303 is deenergized, the armature 306 no longer is forced, and the spring 298 is effective to seat the valve poppet 297. The clearances are such that the volume around the armature 306 and around the stem 302 and within the cartridge are arranged for ready pressure equalization. A special small duct 307 allows pressure transfer between the chamber 292 and the chamber 293 so that the valve 297 is vertically balanced and can be moved with only a small amount of current in the coil 303.

Within the block 281 there is a cross pressure passage 308 extending through the lower chamber 293 of the valve 282 as well as into the lower chamber 293 of the valve 283. The cross passage opens through a pressure duct 309 to a source of hydraulic fluid under pressure, as before. Pressure fluid therefore has access to the lower chamber 293 and through and around the valve cartridge 289, except as it is blocked by an intermediate O-ring. When the valve 297 is open, pressure fluid also has access around the valve to the space around the valve stem, from which fluid can flow through a number of radial passages 311 into an intermediate chamber 312.

Flow from the chamber 312 is into a hydraulic mechanism passage, referred to in connection with the valve 282 as a passage 313 A since it goes to a hydraulically responsive mechanism, not shown but designated A. For the valve 283 there is a similar passage 313 B extending to another hydraulically responsive mechanism, not shown but designated B. Thus, when the poppet 297 is open in valve 282, the passage 313 A is supplied with pressure fluid. similarly, when the corresponding poppet 297 in the valve 283 is similarly opened, the passage 313 B is supplied with fluid under hydraulic pressure. When the poppet valve 297 is closed, the passage 313 A is isolated, and a similar condition obtains under similar circumstances for the passage 313 B.

Also located in the block 281 for the similar valves 284 and 286 are low pressure cartridges 314 and 316 (FIG. 12) virtually identical, so that a description of one applies equally to the other. The cartridge 314, for example, has a threaded portion 317 screwed into the block 281 and extends upwardly in a bore 318 in the block, the bore being along the vertical axis 319. Near the lower end the bore is enlarged to provide a lower chamber 321 isolated by an O-ring from an intermediate chamber 322 in turn isolated by an O-ring from an upper chamber 323.

The cartridge has a central cylinder 324 closed at the bottom and extending upwardly to receive a poppet valve 326. The stem of the poppet valve 326 at its lower portion provides a guide 327 of about the diameter of the seat of the poppet valve and stopping short of the bottom of the cylinder 324 to leave a volume 328. There is communication between a reduced portion of the poppet valve stem under the valve head and the chamber 322 by means of a plurality of radial bores 329. There is ready communication through ports 331 between a space 332 around the upper portion of the valve stem and the chamber 323.

As particularly shown in FIGS. 9 and 10, the passage 313 A not only intersects the chamber 312, but also intersects the chamber 323. The similar passage 313 B intersects the corresponding chambers of the valve 286. In a comparable fashion, there is a drain passage 333 A for the valve 284 and a drain passage 333 B for the valve 286, these passages respectively extending between the intermediate chambers 322 and the face of the block 281.

When the valves 282 and 284 are connected to a hydraulic mechanism A and the valves 283 and 286 are connected to a hydraulic mechanism B through the various passages described, and when pressure and drain or tank connections are made, the device is ready for operation. When the solenoid 303 of the valve 282 is energized, the poppet 297 is opened and pressure fluid from the port 309 and from the chamber 293 flows upwardly around the open poppet 297 through the radial ports 311 into the chamber 312 and from there into the passage 313 A, tending to expand the related hydraulic mechanism A. It is usually desired under those conditions simultaneously to connect the related hydraulic mechanism B to drain. A special provision is made for that purpose. When the valve 297 opens and high pressure is admitted, as described, to the line 313 A at the valve 282, that pressure is also transmitted through the intersecting passage 313 A to the upper chamber 323 of the valve 284. That high pressure is then specially transmitted through a cross passage 334 A from the chamber 323 of the valve 284 to the lower chamber 321 of the other valve 286. There is a similar cross passage 334 B connecting the upper chamber 323 of the valve 286 to the lower chamber 321 of the valve 284.

When the high pressure gets into the lower chamber 321 of the valve 286, it is effective to open the poppet valve 326 therein. Thereupon the passage 313 B from the hydraulic device B is connected around the open valve 326 of the valve 286 and through the radial passages 329 thereof the tank or drain passage 333 B. This relieves pressure from the hydraulic device B and permits hydraulic expansion under pressure of the hydraulic device A.

A very similar sequence of events occurs when the solenoid 303 for the valve 283 is energized and the solenoid 303 of the valve 283 is deenergized. In this event the opposite transactions take place between the hydraulic mechanisms A and B.

Should fluid be generally trapped on the high pressure side of the poppets 326 in the valves 284 and 286, those poppets might not open properly. There is thus provided in each of the cartridges 314 and 316 a small bleed port 336 extending between the chamber 332 and the chamber 322 intersected by the drain passage 333 A, for example. While the bleed port always permits some flow of pressure hydraulic fluid to drain, the influx of pressure fluid from the passage 313 A, for example, is greatly in excess of the drain amount when the valve 297 is open. However, when the valve 297 is closed, then the pressure in the passage 313 A and in the chamber 332 drops due to drainage through the port 336 to the drain passage 333 A. Later on, when pressure fluid is transmitted, for example, through the passage 334 B to the chamber 328 beneath the valve guide 327, such pressure is easily effective to lift the poppet 326, so that the line 313 A is then directly connected through the open valve to the drain 333 A.

With this arrangement, and by appropriate energization of one of the solenoids 303, the related hydraulic mechanism A is pressurized and its cooperating mechanism B is connected to drain automatically. When the other solenoid 303 is energized, the hydraulic mechanism B is pressurized and its opposite mechanism A is connected to drain automatically. This operation is all done by solenoids and poppet valves arranged with their axes vertically and connected to operate in a generally balanced condition and for a protracted period with only minimum and uniform wear.

What is claimed is:

1. A valve and control therefor comprising a main valve body having a main bore therein and having therein pressure, tank and cylinder passages merging with said main bore; a main valve spool reciprocable in said main bore and having lands and grooves variously to interconnect and isolate said passages; means at one end of said main valve body defining a first chamber in which one end of said main valve spool is exposed; means at the other end of said valve body defining a second chamber in which the other end of said main valve spool is exposed; centering springs in said chambers bearing against said ends of said main valve spool;

a pilot valve body having a pilot bore therein; a first capsule having a flow passage with a first valve seat therein disposed in one end of said pilot bore; a first poppet valve in said first capsule and movable to and from said first valve seat; means defining a bore in said first capsule extending around said first valve seat; a second capsule having a flow passage with a second valve seat therein disposed in the other end of said pilot bore; a second poppet valve in said capsule and movable to and from said second valve seat; means defining a bore in said second capsule extending around said second valve seat; a pilot spring in said pilot bore and bearing against said first and said second poppet valves; means on said pilot valve body for individually operating said poppet valves against said pilot spring; and means including passages in said pressure and said tank passages and with said first and second chambers.

2. A device as in claim 1 in which a first one of said passages interconnects said first capsule and said first chamber, a second one of said passages interconnects said second capsule and said second chamber, and said pressure passage connects to both said first one of said passages and said second one of said passages.

3. A device as in claim 1 including a conduit interconnecting said tank passage and said pilot bore between said capsules.

4. A device as in claim 1 in which said operating means are solenoids.

5. A device as in claim 1 including a shunt passage in said pilot valve body interconnecting otherwise separate passages respectively interconnecting said first capsule and said first chamber and said second capsule and said second chamber.

* * * * *